US009771800B2

(12) United States Patent
Dvorák

(10) Patent No.: US 9,771,800 B2
(45) Date of Patent: Sep. 26, 2017

(54) ROTARY MOTOR WITH GEARED TRANSMISSION FOR USE OF COMPRESSIBLE MEDIA DRIVE

(71) Applicant: Jirí Dvorák, Olomouc (CZ)

(72) Inventor: Jirí Dvorák, Olomouc (CZ)

( * ) Notice: Subject to any disclaimer, the term of this patent is extended or adjusted under 35 U.S.C. 154(b) by 66 days.

(21) Appl. No.: 14/910,150

(22) PCT Filed: May 11, 2015

(86) PCT No.: PCT/CZ2015/000041
§ 371 (c)(1),
(2) Date: Feb. 4, 2016

(87) PCT Pub. No.: WO2015/176692
PCT Pub. Date: Nov. 26, 2015

(65) Prior Publication Data

US 2016/0194960 A1 Jul. 7, 2016

(30) Foreign Application Priority Data

May 22, 2014 (CZ) ..... 2014-352

(51) Int. Cl.
*F01C 1/07* (2006.01)
*F01C 11/00* (2006.01)
(Continued)

(52) U.S. Cl.
CPC ..... *F01C 21/008* (2013.01); *F01C 1/077* (2013.01); *F01C 1/104* (2013.01); *F01C 11/002* (2013.01);
(Continued)

(58) Field of Classification Search
CPC ..... F01C 1/077; F01C 1/104; F01C 11/002; F01C 17/02; F01C 21/008; F01C 21/08; F01C 21/106
(Continued)

(56) References Cited

U.S. PATENT DOCUMENTS 1,700,038 A 1/1929 Feuerheerd
3,221,664 A 12/1965 Jorgen
(Continued)

FOREIGN PATENT DOCUMENTS

CS 173441 B1 2/1977
CZ 296486 A3 6/2004
(Continued)

OTHER PUBLICATIONS

International Search Report (PCT/ISA/210) issued on Sep. 18, 2015, by the European Patent Office as the International Searching Authority for International Application No. PCT/CZ2015/000041.
(Continued)

*Primary Examiner* — Mark Laurenzi
*Assistant Examiner* — Dapinder Singh
(74) *Attorney, Agent, or Firm* — Buchanan Ingersoll & Rooney PC

(57) ABSTRACT

A rotary motor with a geared transmission which contains a stator which is procured with triangular cavities which are procured with rounded peaks from which into each is led in at least one canal for entry and exit of compressible medium where in each cavity is embedded a rotary piston with an elliptical crosscut in the way that its lengthwise axis which is parallel with an axis of a rotary element is displaced regarding to a lengthwise axis of the inner cavity of the stator to reach a planetary movement of the rotary piston where the mutual coupling of the rotary pistons with a driven mechanism is achieved by led out of following pins of the rotary pistons out of the cavities of the stator where they are procured with rotary cog wheels which are mutually coupled with the geared elliptical rotary element which is connected with the driven mechanism.

4 Claims, 8 Drawing Sheets

Figure 1:
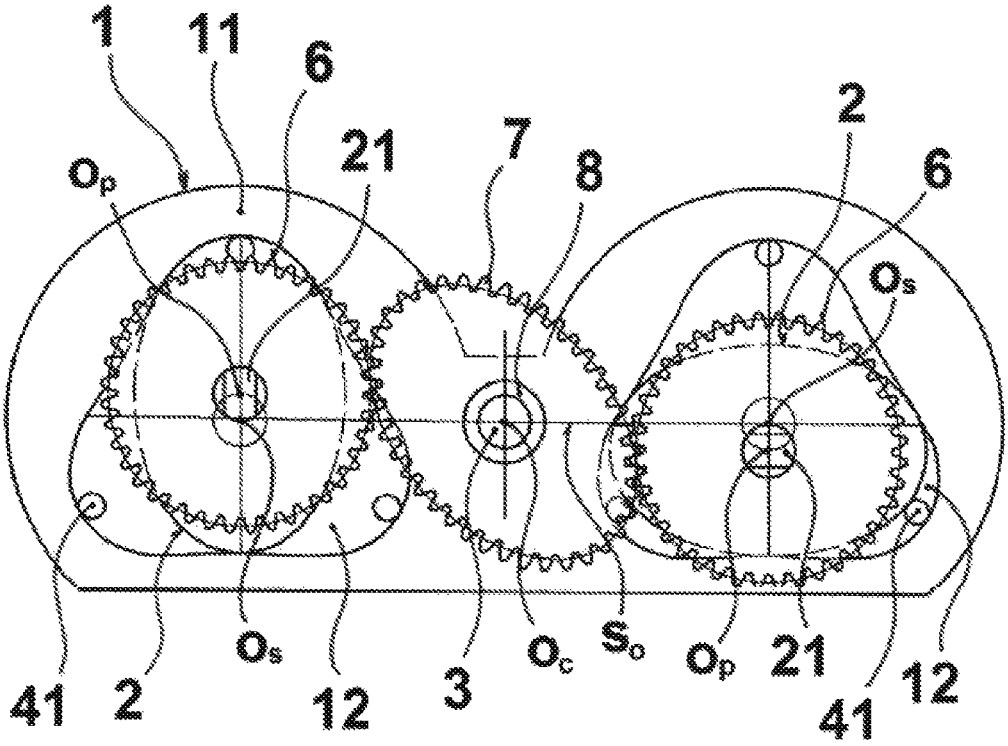

(51) Int. Cl.

| | |
|---|---|
| ***F01C 17/02*** | (2006.01) |
| ***F01C 21/00*** | (2006.01) |
| ***F01C 21/08*** | (2006.01) |
| ***F01C 21/10*** | (2006.01) |
| ***F01C 1/077*** | (2006.01) |
| ***F01C 1/10*** | (2006.01) |

(52) U.S. Cl.
CPC ..... *F01C 17/02* (2013.01); *F01C 21/08* (2013.01); *F01C 21/106* (2013.01)

(58) Field of Classification Search
USPC ..... 418/150, 160, 161, 164, 166
See application file for complete search history.

(56) References Cited

U.S. PATENT DOCUMENTS

| | | | | |
|---|---|---|---|---|
| 4,551,073 | A * | 11/1985 | Schwab | A61M 1/1081 417/352 |
| 4,797,077 | A * | 1/1989 | Anderson | F01C 1/16 418/201.3 |
| 5,174,742 | A | 12/1992 | Putney | |
| 5,527,165 | A * | 6/1996 | Schadeck | F01C 1/07 418/36 |
| 6,974,313 | B2 * | 12/2005 | Beaudoin | F01C 1/22 418/186 |
| 2004/0244762 | A1 | 12/2004 | Schapiro et al. | |
| 2011/0171053 | A1 | 7/2011 | Dvorak | |
| 2012/0080006 | A1 | 4/2012 | Yeh | |

FOREIGN PATENT DOCUMENTS

| | | | |
|---|---|---|---|
| CZ | 302294 | B6 | 2/2011 |
| JP | 6-017601 | A | 1/1994 |
| JP | 7-247949 | A | 9/1995 |
| JP | 11-173101 | A | 6/1999 |
| WO | WO 91/14081 | A1 | 9/1991 |
| WO | WO 03/014527 | A1 | 2/2003 |
| WO | WO 2010/012245 | A1 | 2/2010 |

OTHER PUBLICATIONS

Written Opinion (PCT/ISA/237) issued on Sep. 18, 2015, by the European Patent Office as the International Searching Authority for International Application No. PCT/CZ2015/000041.

* cited by examiner

ROTARY MOTOR WITH GEARED TRANSMISSION FOR USE OF COMPRESSIBLE MEDIA DRIVE

THE FIELD OF THE INVENTION

This invention concerns a construction of a rotary motor with geared transmission for use of compressible media drive, especially a motor driven by compressible gas or steam.

THE PRESENT PRIOR ART

Currently are generally known constructions of classic air or steam motors containing a crank mechanism and a reversible moving piston, whose disadvantage are energy losses at change of direction of the piston. Similar solutions are also motors where the cranks system is replaced by a skew plate. Further known solutions of rotary pneumatic motors use eccentric mounting of a rotor and use of movable seal lamellas as it is described for example in the files U.S. Pat. No. 5,174,742, JP 11173101 or JP 7247949. In these solutions is not used a whole path of rotation for energy transfer and hereby comes to decrease of total efficiency. These motors operate in high revolution area with high consumption of compressible media, low gyroscopic moment and lifecycle of seal lamellas.

Next known solutions are systems of rotary pneumatic motors with two or more shaped rotors, which during rotation form variable flexible work spaces as it is for example by constructions according to the files JP 6017601, CS 173441, CZ 296486 or U.S. Pat. No. 4,797,077. By these solutions is again impossible to take advantage of whole path of rotation for energy transfer. Big areas with necessity to be sealed are also disadvantage, as well as bigger total weight of motors with high production demandingness.

Finally there are known solutions of systems with rotary pistons which are connected with two or more eccentric pegs whose movement is controlled with cogs, as it is described for instance in the files U.S. Pat. Nos. 3,221,664, 1,700,038 or WO 91/14081. These systems do use whole path of rotation but at the cost of higher structural complexity and production demandingness. There is likewise known solution according to the file WO 2010012245 which comes from the patent CZ 302294 and which describes a rotary motor for compressible media which contains a rotor and a stator mounted between two mutually coupled and a in parallel placed bearing plates which are modified for mounting of a two side made crank of the rotor on which is mounted a rotary piston which is mounted in a stator chamber which is procured with sealing lids. The rotary piston of this motor has an elliptical cross cut and is mounted in a symmetrically shaped triangular chamber which is procured with rounded peaks from which each of them is equipped with at least one canal for entry and exit of compressible medium whereas there is mounted to one from the bearing plates on a driving shaft a central cog around whose perimeter are evenly placed three satellite cogs which are firmly set on the pegs rotary mounted in the bearing plate and coupled with the stator by the help of following pins fixed to the stator with eccentricity regarding to the pegs axes. A disadvantage of this design is quite complex structure of the motor which contains many structural parts as are bearing bodies including bearings and satellite cogs with eccentric following pins and herewith is increased production complexity with significant requirements for accuracy of design of mutually meshing parts.

The goal of presented invention is to introduce a completely new and simple design of a rotary motor with minimal number of moving production undemanding components with high operational efficiency and reliability, which takes up solution of a motor according to the file CZ 302294 and basically removes all imperfections found during operation tests.

ESSENCE OF THE INVENTION

The defined goal is reached with an invention which is a rotary motor with geared transmission for use of compressible media which contains a stator which is procured with at least one, preferably two, triangular cavities which are sealed to surrounding environment and which are procured with rounded peaks from which into each of them is led in at least one canal for entry and exit of compressible medium where in each cavity is embedded a rotary piston with an elliptical crosscut in the way that its lengthwise axis, which is parallel with the axis of a rotary element, is displaced regarding to lengthwise axis of the inner cavity of the stator of a value of eccentricity in order to reach a planetary movement of the rotary piston namely during the displacement of the lengthwise axis of the rotary piston along a circle with radius of the eccentricity. The essence of the invention is that the mutual coupling of rotary pistons with driven mechanism is achieved by led out of following pins of the rotary pistons out of the cavities of the stator where they are mutually coupled with the geared elliptical rotary element which is connected with the driven mechanism.

In an advantageous design a shape of cavity of the stator is formed in the way that it consists of three symmetric parts whose rounded peaks which are mutually turned of 120° and are formed on radius ($R_v$) of circumscribed circle which has value $$R_v=a+e,$$

where (a) is the length of big half axis of ellipse of the rotary piston and (e) is eccentricity which is given by displacement of axis of the cavity of the stator and the axis of rotation of rotary piston, whereas not only rounding of the peaks of the cavity corresponds with the rounding of the rotary piston but also walls of the cavity which are opposed to the peaks are formed on the radius $R_s$ of an inscribed circle which has value $$R_s=b+e$$

where (b) is the length of small half axis of the ellipse of the rotary piston and (e) is an eccentricity and also transition parts of the surface of the cavity between the peaks and the walls are formed with an envelope curve of moving rotary piston.

Likewise it is advantageous when the rotary cog wheels and the elliptical rotary element are dimensionally formed in the way that the radius ($k_r$) of spacing circle of the cog wheel has the size which corresponds with a value ($R_s$) modified for selected module of gearing with even amount of teeth, the elliptical rotary element has the same amount of teeth as cog wheel and it is formed in the way that between the big half axis ($a_r$) of the spacing ellipse, the small half axis ($b_r$) of the spacing ellipse and the eccentricity (e) is relation $$a_r=b_r+2e,$$

whereas the size of the big axis ($a_r$) of the spacing ellipse is defined by selected radius ($k_r$) of the spacing circle and the eccentricity (e) in relation $$a_r=k_r+e$$

and the distance (t) of the axis of the rotation of the rotary element from the lengthwise axis of the cavity of the stator has value $$t=k_r+a_r-e.$$

Finally it is advantageous when the position of the gearing on the rotary cog wheels and the elliptical rotary element is carried out in the way that at positioning of the big half axis ($a_r$) and also of the small half axis ($b_r$) of the geared rotary element into the position parallel with the join ($s_o$) of the axes of the cavities are the big half axes (a) of the rotary pistons mutually turned of 45°.

With this new solution of the motor is reached maximal use of movement of two mutually turned rotary pistons and in their connection with drive geared elliptical rotary element for direct transfer of gyroscopic moment when during one revolution of the rotary piston comes to six incoming impulses of compressible medium which moreover mutually overlap. Herewith is reached also dynamic balance of the movement of rotary pistons and likewise full overlap of particular entry impulses of compressible medium when for one revolution of drive geared rotary element is 12 of these impulses. Herewith is the operating track of the rotary piston perfectly used and completely fall off reversing or dead motions.

An advantage is an immediate gyroscopic moment already at entry of working medium without necessity of a starter or a clutch. Maximal gyroscopic moment is reached already with low resolutions and herewith is given low consumption of working medium and long service life of mechanical parts with minimal amount of friction couples.

Further advantages of this solution is a possibility to use movement of a shaft of rotary pistons for control of mechanical or electromagnetic incoming and outgoing valves of compressible medium with possibility of change of their timing for optimization of performance of the engine or reversal of revolutions. An advantage especially for steam drive is also positioning of cog wheels and bearing completely out of the workspace. Overall solution of the engine is very simple and easy for production with possibility to use modern technologies and materials for production of particular components of this motor.

Suggested solution can operate even as a compressor for compressing of gaseous substances whereas from the environment protection point of view is the next advantage of this solution its relatively low noisiness of motor operation and absence of harmful air pollutants during its operation. When the suitable materials are used there is not necessity of lubrication at all.

DESCRIPTION OF FIGURES IN ENCLOSED DRAWINGS

Figure 2:
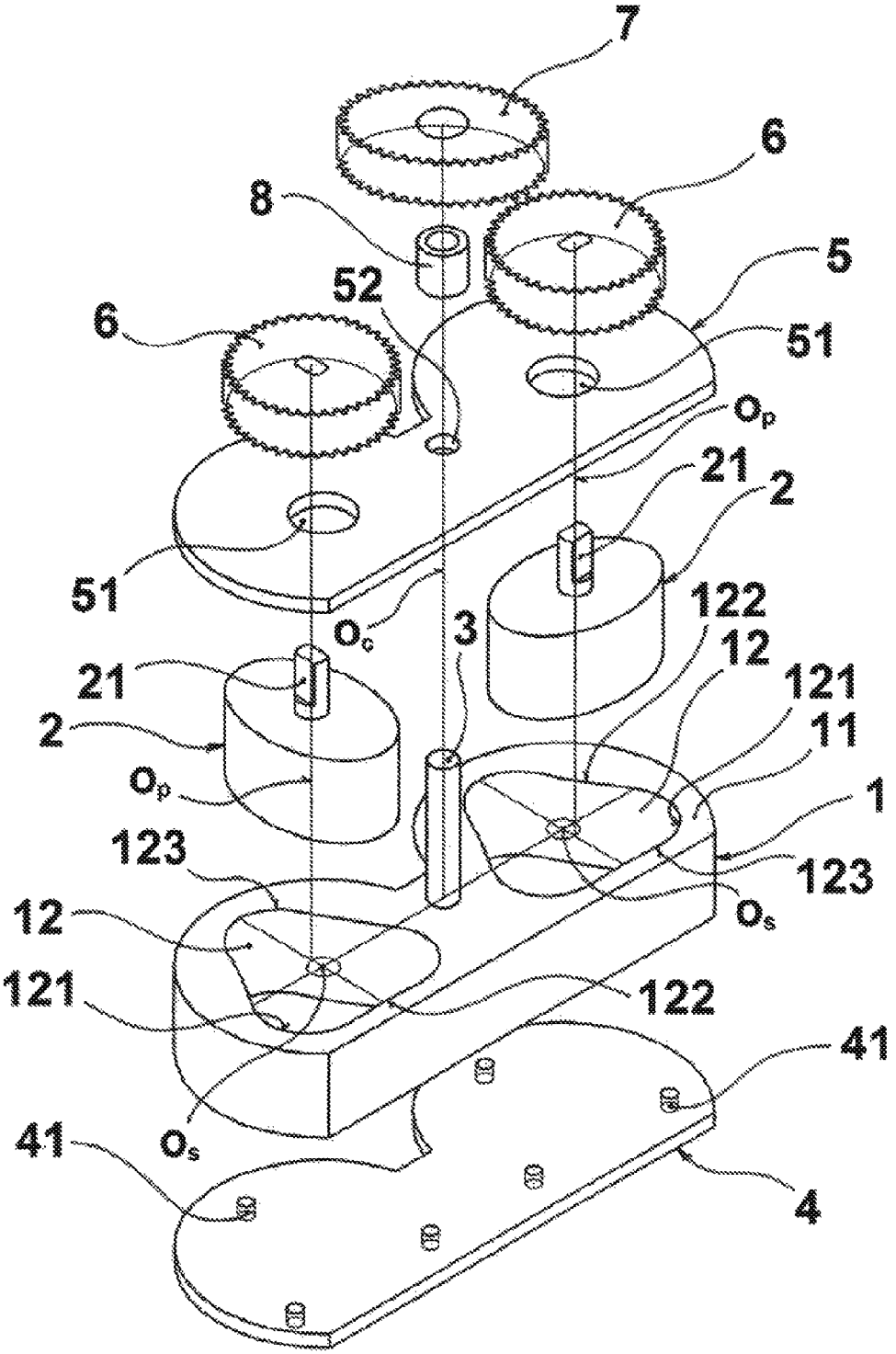
Figure 3:
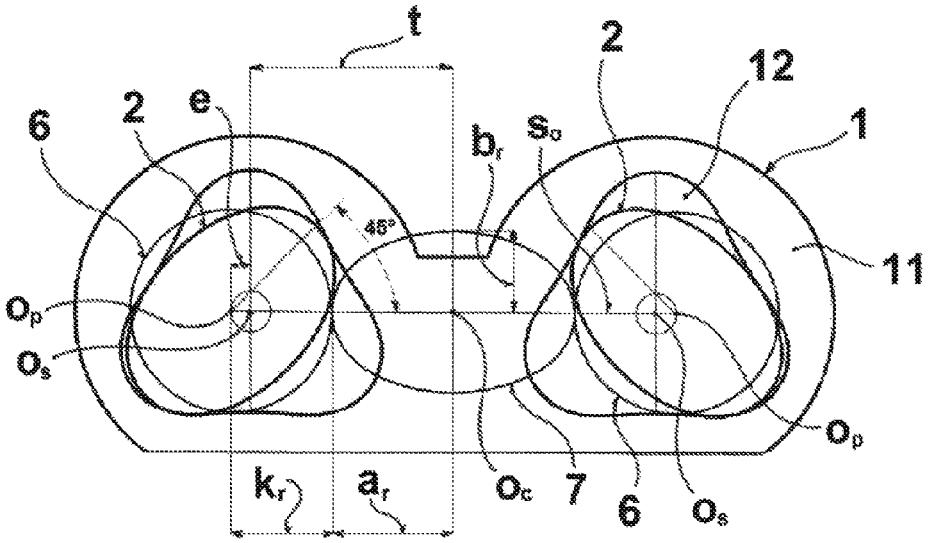
Figure 4:
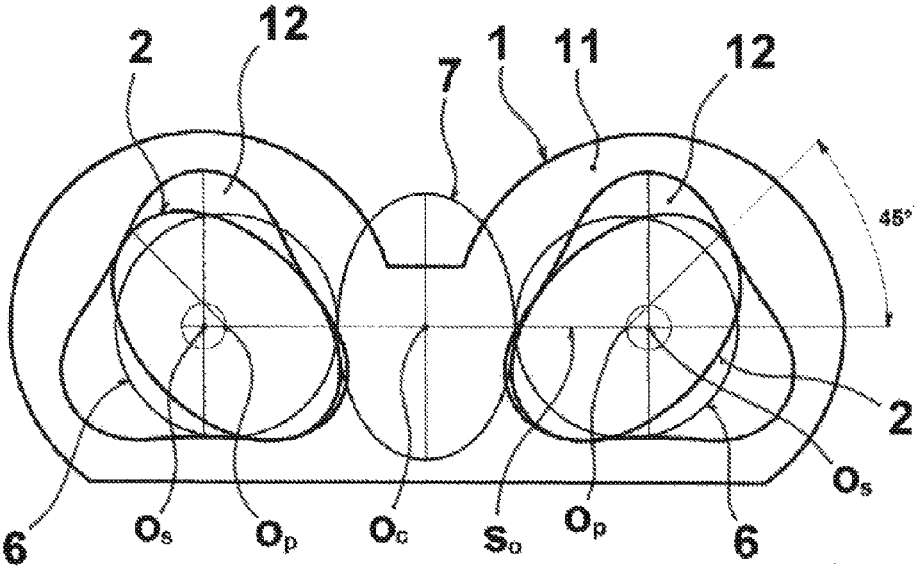
Figure 5:
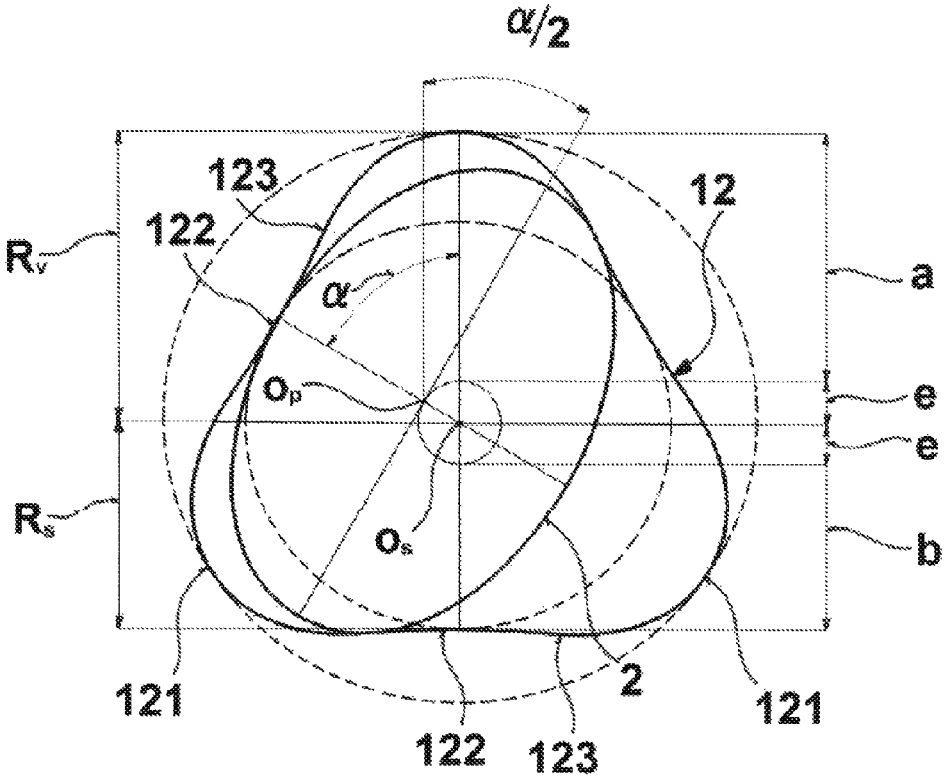
Figure 6:
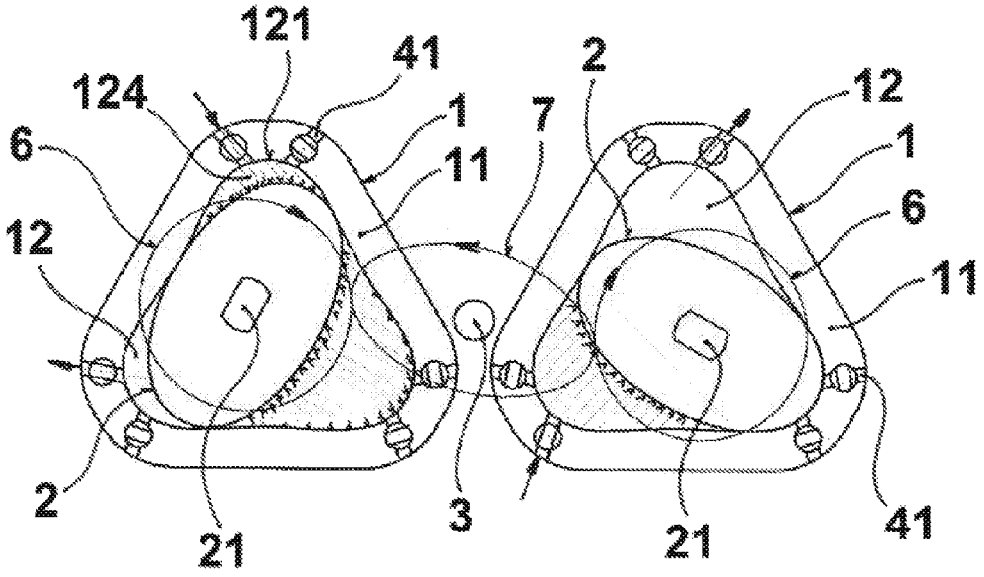
Figure 7:
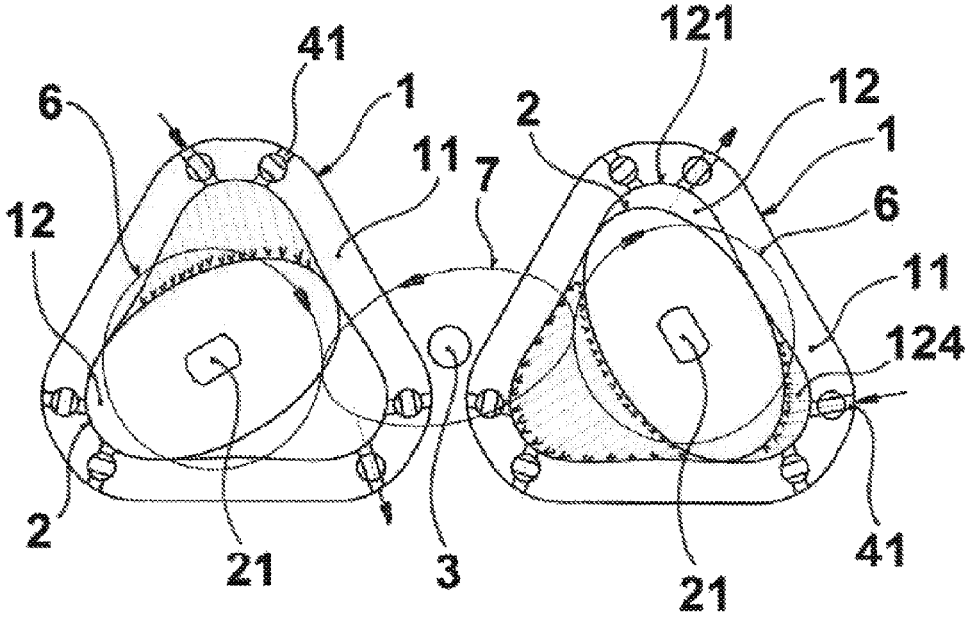
Figure 8:
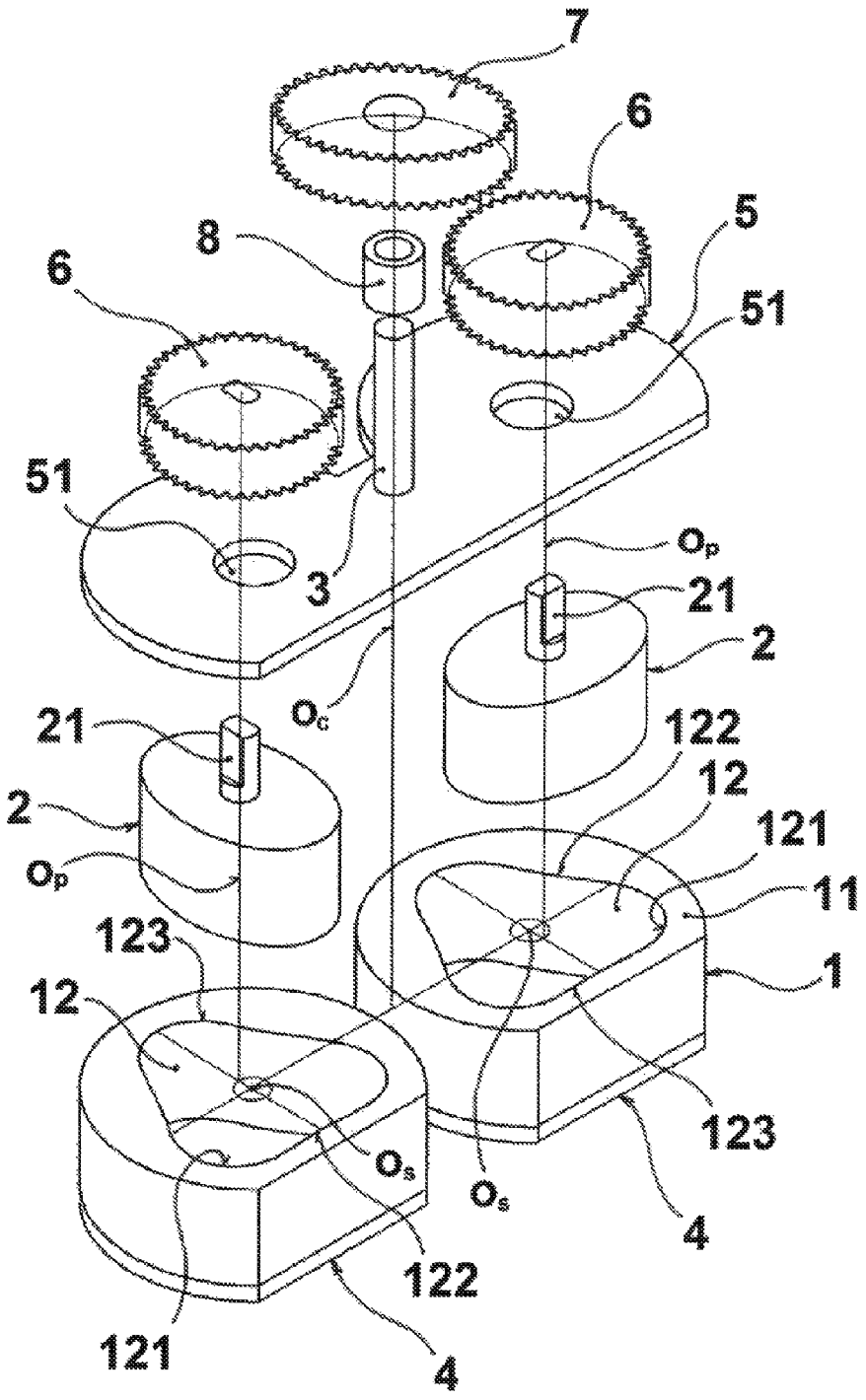
Figure 9:
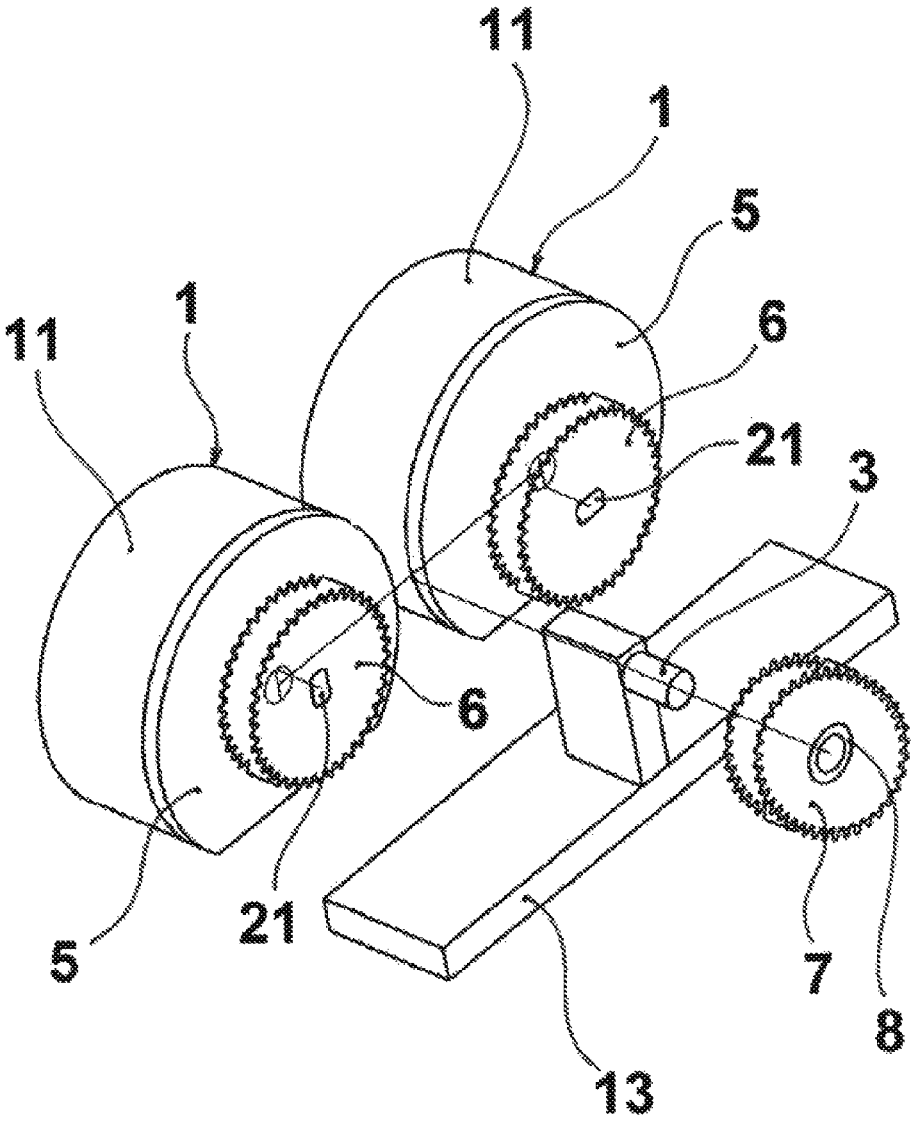
Figure 10:
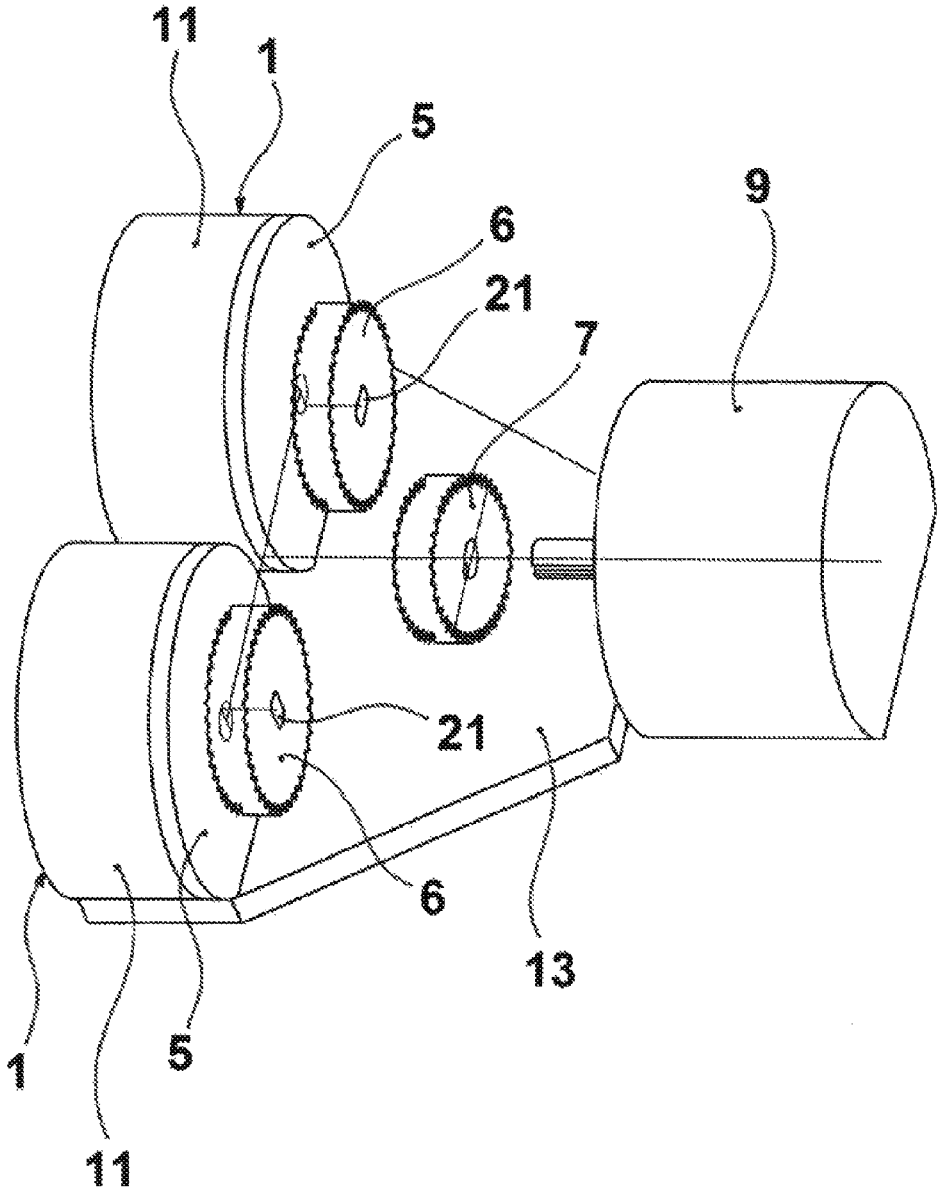

Particular examples of motor design according to the invention are schematically illustrated in enclosed drawings where:

FIG. 1 is a front view of a basic design of a motor from the side of geared transmissions, FIG. 2 is an axonometric view of the motor from FIG. 1 in exploded design, FIG. 3 and FIG. 4 are geometric schemes of the motor with illustration of setting of both end positions of ellipses of rotary pistons and a rotary element with turning of main half axes of 45°, FIG. 5 is a detail of geometric scheme of one cavity of a stator with illustration of basic functional elements FIG. 6 and FIG. 7 are schematic front views of the motor with illustration of particular phases of motor activity with an alternative solution of couples of canals in peak parts of the cavity, FIG. 8 is an axonometric view of an alternative design of the motor in an exploded design, its stator if formed with two independent bodies, FIG. 9 is an axonometric view of the motor from FIG. 8 from the side of a rotary element with illustration of an alternative solution of mounting of a bearing peg of a base plate of stators and FIG. 10 is an axonometric view of an alternative solution of the motor with mounting of a rotary element on shaft of driven mechanism.

EXAMPLES OF INVENTION DESIGN

In a basic design according to the FIGS. 1 and 2 the motor consists of a stator 1 which is formed with a shaped body 11 which is procured with two triangular cavities 12, in each of them is embedded a rotary piston 2 with an elliptical crosscut which is procured in its axis $o_p$ of rotation with a following pin 21. In the middle of the distance between the central axes $o_s$ of cavities 12 is the body 11 is procured with a bearing pin 3 which is situated in parallel with the following pins 21 of the rotary pistons 2. The cavities 12 of the stator 1 are two-side closed and sealed with a back lid 4 and a front lid 5 which are fixed to the surfaces of the body 11 in demountable way preferably screwed down. The back lid 4 is procured with six canals 41 for flow of working medium and these are led into peak parts of the cavities 12. The front lid 5 is procured not only with two centric openings 51 for possibility of free passage of the following pins 21 abut also with one central opening 52 for permeance of the bearing pin 3.

Behind the front lid 5 are on the following pins 21 mounted, for example pressed on, rotary cog wheels 6 which are mutually coupled with a geared elliptical rotary element 7 embedded on a bearing 8 which is placed on the bearing pin 3.

A shape of the cavity 12 of the stator 1 schematically illustrated in FIG. 5 is formed in the way that it consists of three symmetric parts whose rounded peaks 121 mutually turned of 120° are formed on a radius $R_v$ of a circumscribed circle, which has a value $$R_v=a+e,$$

where a is length of big half axis of the ellipse of the rotary piston 2 and e is eccentricity defined by movement of the axis $o_s$ of the cavity 12 of the stator 1 and the axis $o_p$ of rotation of the rotary piston 2. The rounding of the peaks 121 of the cavity 12 then corresponds with rounding of the rotary piston 2. Walls 122 of the cavity 12 opposed to the peaks 121 are formed on the radius $R_s$ of an inscribed circle which has value $$R_s=b+e,$$

where b is length of small half axis of the ellipse of the rotary piston 2 and e is above described eccentricity. Transfer parts 123 of the surface of the cavity 12 between the peaks 121 and the walls 122 are formed with an envelope curve of moving rotary piston 2. From above mentioned results that the triangular cavity 12 of the stator 1 is formed by the envelope curve of peak part of the ellipse of the rotary piston 2, which performs a planetary movement during which the centre of the ellipse, thus the axis $o_p$, moves around circle with radius of eccentricity e in particular angle α and simultaneously the axis a of the ellipse, thus the rotary piston 2, turns in opposite direction of half angle α/2 as it is clear from FIG. 3 to FIG. 5.

During formation of an elliptical shape of the rotary piston 2 and a shape of the triangular cavity 12 of the stator 1 is main parameter for determination of size of a rotary motor an optional value of eccentricity e, thus displacement of the axis $o_s$ of the triangular cavity 12 of the stator 1 regarding to the axis $o_p$ of the rotary piston 2. In an optimal case of selection of crosscut of the rotary piston 2 is the length a of the big half axis of the ellipse six times bigger than eccentricity value e, the small half axis b then has to at turning of the rotary piston 2 of 90° touch walls of the triangular cavity 12 of the stator 1 and therefore it is lower of double value of the eccentricity e as it is evident form FIG. 5. Herewith is also given the radius $R_v$ of circumscribed circle of the cavity 12 of the stator 1 as it is described above.

Unmarked width of the rotary piston 2 and herewith also the depth of the triangular cavity 12 of the stator 1 is an optional value according to maximal required capacity of working space 124. An optimal value has to correspond with the size of big half axis of the ellipse a.

Rotary cog wheels 6 and an elliptical rotary element 7 are dimensionally formed in the way that the radius $k_r$ of a spacing of circle of cog wheel 6 has size which corresponds with value $R_s$ which is modified for selected module of gearing with even amount of teeth. The elliptical rotary element 7 has same amount of teeth as the cog wheel 6 and it is formed in the way that between the big half axis $a_r$ of the spacing ellipse, the small half axis $b_r$ of the spacing ellipse and the eccentricity e is relation $$a_r=b_r+2e,$$

whereas the size of the big half axis $a_r$ of the spacing ellipse is given by selected radius $k_r$ of the spacing circle and by the eccentricity e in the relation $$a_r=k_r+e$$

The distance t of the axis $o_c$ of rotation of the rotary element 7 which is identical with the axis $o_c$ of a bearing pin 8 from the lengthwise axis $o_s$ of the cavity 12 of the stator 1 has value $$t=k_r+a_r-e,$$

as it is evident form the FIGS. 3 and 4.

The activity of the motor according to the FIGS. 6 and 7 is possible to determine from the start position of the rotary piston 2 which is with its one rounding in one from the peaks 121 of the cavity 12 of the stator 1 where seals appropriate canal 41 of the back lid 4 for entry of compressible medium whereas with its front surfaces both side symmetrically touches both walls of both lids 4, 5. After turning of the rotary piston 2, illustrated in fig .6, its contact points with both walls of the cavity 12 start to draw apart and in the cavity 12 arises working space 124 into which through adjacent canal 41 via non illustrated valve starts to flow working medium which with its expanse turns the rotary piston 2 right up until maximal possible capacity which is after turning of the rotary piston 2 of 90°. Simultaneously is on the opposite part of the rotary piston 2 finished former working cycle in the working space 124 by the second peak 121 which is emptied via appropriate canal 41 and non-illustrated valve. After emptying the rotary piston 2 comes by this peak 121 into start position and the process repeats there in above described way. Regarding to the triangular shape of the cavity 12 of the stator 1 therefore proceeds entry of compressible medium against direction of turning of the rotary piston 2 namely always after its turn of 60° thus six times for one revolution. It is evident that particular working cycles which proceed in the working spaces 124 of appropriate peaks 121 mutually overlap because maximal working space 124 is reached after turning of working piston of 90° but already after its turn of 60° starts next working cycle by the neighbouring peak 121.

For transmission of the planetary movement of the rotation pistons 2 on the rotary movement of the elliptical rotary element 7 is taken advantage of the fact that at mutual turning of big half axes a of the rotary pistons 2 of 90° and their movement in the same direction there comes at the join $s_o$ of central axes $o_s$ of the cavities 12 to symmetric approximation and retreat of perimeters of rotary cog wheels 6 of value double of the eccentricity e. Transmission of the planetary movement of cog wheels 6 on the rotary movement is obtained due to elliptical crosscut of the elliptical rotary element 7 which is placed in the middle of the join $s_o$ of the central axes $o_s$ of the cavities 12.

The position of gearing on rotary cog wheels 6 and the elliptical rotary element 7 has to be done in the way to have big half axes a of the rotary pistons 2 mutually turned of 45° after turning of the big half axis $a_r$ and also of the small axis $b_r$ of the geared rotary element 7 into position which is parallel with the join $s_o$ of the central axes $o_s$ as it is evident from FIGS. 3 and 4.

Herewith is reached not only transmission of the planetary movement of cog wheels 6 on the rotary movement of the rotary element 7 but also dynamic balance of the planetary movement of the rotary pistons 2 and the cog wheels 6, moreover then also full overlap of particular impulses of working medium.

Described structural design is not the only possible design of the rotary motor according to the invention when in dependence on its size and required performance the stator 1 of the motor can be formed with two independent bodies 11 which are mounted on one base plate 13 as it is suggested in FIGS. 9 and 10 or the back lid 4 can be an integrated solid part of the back wall of the body 11 of the stator 1. The bearing pin 3 does not have to be mounted in the body 11 of the stator 1 but it can be in the front lid 5 as it is illustrated in FIG. 8 and into each peak part of the cavity 12 of the stator 1 can be led in more than one, preferably two, canals 41 which do not have to be directed through the back lid 4 in parallel with the axes of rotation of the rotary pistons 2 but through side walls of the body 11 of the stator 1 in perpendicular direction to these axes $o_p$ of rotation as it is evident from FIGS. 6 and 7. The following pins 21 of the rotary pistons 2 can be designed also like through-shafts through the centre of the rotary piston 2 with led out through the back lid 4 with use for control of valves of the motor. Eventually the elliptical rotary element 7 can be mounted, instead of the bearing pin 3, on an unmarked shaft of the driven mechanism 9 for example on an alternator, transmission etc, placed on common base plate 13 as it is illustrated in FIG. 10. The bearing pin 3 does not have to be formed on the body 11 of the stator 1 according to the FIG. 2 but can be formed on the front lid 5 at it is clear from FIG. 8 or can be mounted on the base plate 13 as it is illustrated in FIG. 9 From the functional point of view of the motor is likewise irrelevant when in the solution according to the FIG. 2 the body 11 would be procured with a bearing 8 and the elliptical rotary element 7 with the bearing pin 3. It is obvious that without the impact on the essence of the solution is possible to change, according to use of the motor, an outline design of the stator 1 in dependence on size of build-up area where the motor should be placed.

From above mentioned it is clear that general description of the rotary motor is carried out only universally and does not solve next related and non-illustrated structural knots as are for example valves including their control and supply, lubrication, cooling, fly wheel, concretization of gearing profile etc, which do not have influence on the essence of presented solution.

INDUSTRIAL EFFICIENCY

The rotary motor according to the invention is possible to use in different branches of the industry and transport as an ecologically clear drive unit of machines, vehicles and other devices.

LIST OF REFERENCE NUMERALS

1 Stator
11 Body
12 Cavity
121 Peak
122 Wall
123 Transition part of the surface
124 Working space
2 Rotary piston
21 Following pin
3 Bearing pin
4 Back lid
41 Canal
5 Front lid
51 Centric opening
52 Central opening
6 Rotary cog wheel
7 Elliptical rotary element
8 Bearing
9 Driven mechanism
$R_v$ Radius of circumscribed circle
$R_s$ Radius of inscribed circle
a Big half axis of the rotary piston
b Small half axis of the rotary piston
e Eccentricity
$O_p$ Axis of rotation of the rotary piston
$O_s$ Axis of the cavity
$k_r$ Radius of the spacing circle
$a_r$ Big half axis of the spacing ellipse
$b_r$ Small half axis of the spacing ellipse
$o_c$ Axis of rotation of spacing element
$s_o$ Join of axes of cavities

The invention claimed is:

1. A rotary motor with a geared transmission for use of compressible media drive comprising:

a stator which is procured with at least one or more triangular cavities which are sealed to surrounding environment and which are procured with rounded peaks from which into each is led in at least one canal for entry and exit of compressible medium where in each of the one or more triangular cavities is embedded a rotary piston with an elliptical crosscut in a way that its lengthwise axis ($O_p$) which is parallel with an axis ($O_c$) of a geared elliptical rotary element is displaced regarding to a lengthwise axis ($O_s$) of the inner cavity of the stator of a value of eccentricity (e) in order to reach a planetary movement of the rotary piston namely during the displacement of the lengthwise axis ($O_p$) of the rotary piston along a circle with radius of the eccentricity (e) wherein, mutual coupling of the rotary pistons with a driven mechanism is achieved by led out of following pins of the rotary pistons out of the cavities of the stator where they are procured with rotary cog wheels which are mutually coupled with the geared elliptical rotary element which is connected with the driven mechanism.

2. The rotary motor according to the claim 1, wherein a shape of the cavity of the stator is formed in a way that it consists of three symmetric parts whose rounded peaks are mutually turned of 120° and are formed on radius ($R_v$) of a circumscribed circle which has value $$R_v=a+e,$$

where (a) is length of a big half axis of the ellipse of the rotary piston and (e) is eccentricity given by displacement of the axis ($o_s$) of the cavity of the stator and the axis ($o_p$) of the rotation of the rotary piston, whereas not only a rounding of the peaks of the cavity corresponds with a rounding of the rotary piston but also walls of the cavity which are opposed to the peaks are formed on a radius ($R_e$) of an inscribed circle which has value $$R_s=b+e,$$

where (b) is length of a small half axis of the ellipse of the rotary piston and (e) is eccentricity, and also transition parts of a surface of the cavity between the peaks and the walls are formed with an envelope curve of moving rotary piston.

3. The rotary motor according claim 1, wherein the rotary cog wheels and the elliptical rotary element are dimensionally formed in a way that radius ($k_r$) of a spacing circle of the cog wheel has size which corresponds with value ($R_s$) modified for selected module of gearing with even amount of teeth, the elliptical rotary element has same amount of teeth as the cog wheel and it is formed in a way that between a big half axis ($a_r$) of a spacing ellipse, a small half axis ($b_r$) of the spacing ellipse and the eccentricity (e) is relation $$a_r=b_r+2e,$$

whereas the size of the big half axis ($a_r$) of the spacing ellipse if defined by the selected radius ($k_r$) of the spacing circle with the eccentricity (e) in relation $$a_r=k_r+e$$

and a distance (t) of an axis ($o_s$) of the rotation of the rotary element from the lengthwise axis ($o_s$) of the cavity of the stator has value $$t=k_r+a_r\mathbf{31}\ e.$$

4. The rotary motor according to claim 1, wherein a position of the gearing on the rotary cog wheels and the elliptical rotary element is carried out in a way that after positioning of a big half axis($a_r$) and also a small half axis ($b_r$) of the geared rotary element into position which is parallel with a join ($s_o$) of the axes ($o_s$) of the cavities are the big half axes (a) of the rotary pistons mutually turned of 45°.

* * * * *